US007552565B1

(12) United States Patent
Smith

(10) Patent No.: US 7,552,565 B1
(45) Date of Patent: Jun. 30, 2009

(54) FLOOD BARRIER SYSTEM

(75) Inventor: Jason W. Smith, Pawling, NY (US)

(73) Assignee: The Presray Corporation, Pawling, NY (US)

( * ) Notice: Subject to any disclaimer, the term of this patent is extended or adjusted under 35 U.S.C. 154(b) by 503 days.

(21) Appl. No.: 11/391,110

(22) Filed: Mar. 28, 2006

(51) Int. Cl.
*E06B 3/26* (2006.01)

(52) U.S. Cl. ..... 52/202; 29/281.1; 405/107; 49/61; 49/63; 49/67

(58) Field of Classification Search ..... 52/202, 52/203, 479, 584.1, 741.3, 741.13; 49/463, 49/464, 465, 61, 63, 64; 405/107, 110, 112, 405/114; 70/19; 292/256.67, 256.5, 293; 24/569, 514, 525; 269/135, 291; 29/281.1; 248/221.13, 221.14, 500
See application file for complete search history.

(56) References Cited

U.S. PATENT DOCUMENTS 2,579,995 A * 12/1951 Atchison ..... 269/249
6,393,782 B1 * 5/2002 Berridge et al. ..... 52/239

OTHER PUBLICATIONS

Presray Critical Containment Solutions BuyLine 0412 CGSL Stackable Gasketed Aluminum Stop Log (Illustrates Flood Barrier Publicly Available Since Prior to Mar. 28, 2005).

* cited by examiner

*Primary Examiner*—Richard E Chilcot, Jr.
*Assistant Examiner*—Anthony J Gennaro, Jr.
(74) *Attorney, Agent, or Firm*—St. Onge Steward Johnston & Reens LLC

(57) ABSTRACT

A flood barrier system for sealing an opening in a wall structure against the inflow of flood waters. The system comprises a plurality of elongated, horizontally disposed barrier elements of a length somewhat greater than the width of the opening. The barrier elements are stacked vertically, one upon the other against the outer face of the wall structure. End clamps engage opposite ends of the individual barrier elements to press them snugly against the outer surface of the wall, providing seals along the opposite vertical side edges of the opening. A simplified clamping mechanism is provided above the uppermost barrier element, with provisions to apply vertically downward clamping pressure on the uppermost barrier element, and thus upon the entire series of vertically stacked barrier elements. Each of the barrier elements has a resilient seal along its lower surface, engageable with an upper surface of the neighboring barrier element below such that, when the stack of barrier elements is under clamping pressure from above, effective water seals are provided between each of the barrier elements. An important benefit and advantage of the arrangement is the facility and thickness with which an effective flood barrier may be installed when flooding conditions are imminent.

12 Claims, 6 Drawing Sheets

FLOOD BARRIER SYSTEM

BACKGROUND OF INVENTION

In certain areas, homes, offices and commercial and factory buildings occasionally are inundated by flood waters. In order to minimize damage from rising flood waters, such structures can utilize flood barriers that are installed in low level doors and windows to seal the openings against inflow of water into the structure as the water level reaches and exceeds the level of the window or door openings. Various barrier systems are available for this purpose, with a wide variety of design features dictated to a considerable extent by the size of the opening to be protected.

For the protection of a relatively wide doorway, for example, against flood waters that may rise to a considerable level above the bottom of the door opening, the barrier system must have considerable structural soundness in order to effectively resist the pressure of water across a wide area and at a relatively high level. One such system that is effective for the purpose has been marketed by Presray Corporation, of Wassaic, N.Y. and consists of a series of horizontally elongated barrier elements (sometimes referred to as "stop logs") which are assembled one atop the other, extending laterally across the full width of the door opening. The barrier elements, advantageously of C-shaped cross section, are bolted together, so that one element is tightly sealed to the other, and the individual barrier elements are clamped against the front face of the door opening, providing a full perimeter seal and a strong structure to hold back the rising waters.

As can be appreciated, for many locations, flooding is an infrequent event, perhaps an annual experience, or more likely, a situation that occurs only once in a few years. Thus, it is typical and customary that the barrier systems be stored away during normal times, and installed only when there is an immediate threat of inundation. However, when flooding circumstances arise, there is much work to do in order to seal all of the openings available in a typical structure, and speed and efficiency of installation can be extremely important because all of the low level openings must be sealed before the structure can be considered protected from inundation. In this respect, water flowing in through a single unprotected opening, even though others are protected, can inundate the entire structure and cause great damage.

SUMMARY OF THE INVENTION

The present invention deals with improvements in flood barrier systems of otherwise generally known types to enable them to be installed easily and quickly with minimum personnel, such that the time requirements for making a flood barrier system ready are greatly minimized, providing greater assurance that a structure can be fully protected at all low level openings in a minimum time period. In the flood barrier system of the invention, a plurality of horizontally disposed barrier elements are stacked one on top of the other to form a barrier of the desired height. But instead of bolting each barrier element to its neighbor below, the entire series of barrier elements is stacked in place against the front face of the wall structure surrounding the opening to be protected, and the individual barrier elements are initially held snugly against the front face by means of end clamps engageable with the opposite ends of the barrier elements.

Pursuant to the invention, a novel vertically acting clamping arrangement is provided at the top of the barrier system, at each side thereof. When the barrier elements are positioned in the properly stacked relation, the vertically acting clamping means are engaged at the top of the stack and the entire stack is pressed downward by the clamping action, to form effective seals between the individual barrier elements and between the lowermost barrier element in the underlying floor or other surface at the bottom of the opening. After applying downward pressure to the stack of barrier elements, the individual end clamps are given a final tightening to assure a good lateral seal.

With this structure and new installation procedure, a flood barrier may be installed and made ready in a fraction of the time heretofore required, providing greater assurance that all of the necessary barrier systems may be installed and made ready in advance of the rising flood waters.

To advantage, the clamping mechanisms utilized preferentially in the new system are in the nature pipe-mounted clamps, which are carried by vertical pipe sections mounted at the top of the barrier system. Such clamping arrangements incorporate screw-threaded clamping members of relatively limited range of vertical movement which are carried by clamp bodies slideable vertically over the length of the pipe sections on which they are mounted. Vertical sliding movement of the clamp bodies, when not under load, is easily accomplished, so that the clamp bodies may be raised out of the way during initial installation of the barrier elements. When the last barrier element is installed, the clamp bodies can be slid downward along their carrier pipes until the threaded clamping members engage the upper surface of the uppermost barrier element. As soon, as clamping pressure is applied by the screw elements, the clamp bodies lock in position on the carrier pipes, and significant downward pressure can be applied to the entire stack of the barrier elements to assure the necessary sealing effectiveness between barrier elements.

In the system of the invention, when the flood waters have receded, the barrier elements are removed and stored in an accessible location. The vertically acting pressure clamps, and the horizontally acting end clamps that engage the ends of the barrier elements can be left in place on the wall structure surrounding the opening. A shroud arrangement is provided that is secured over the vertically acting pressure clamps and the end clamps over the entire vertical extent thereof such that all of these elements are concealed from view and protected against being struck by people or equipment. The shrouds can be installed with just a few bolts so as to be quickly and easily removable when the time comes to re-install the flood barrier.

For a more complete understanding of the above and other features and advantages of the invention, reference should be made to the following detailed description of a preferred embodiment, and to the accompanying drawings.

DESCRIPTION OF A PREFERRED EMBODIMENT

Figure 4:
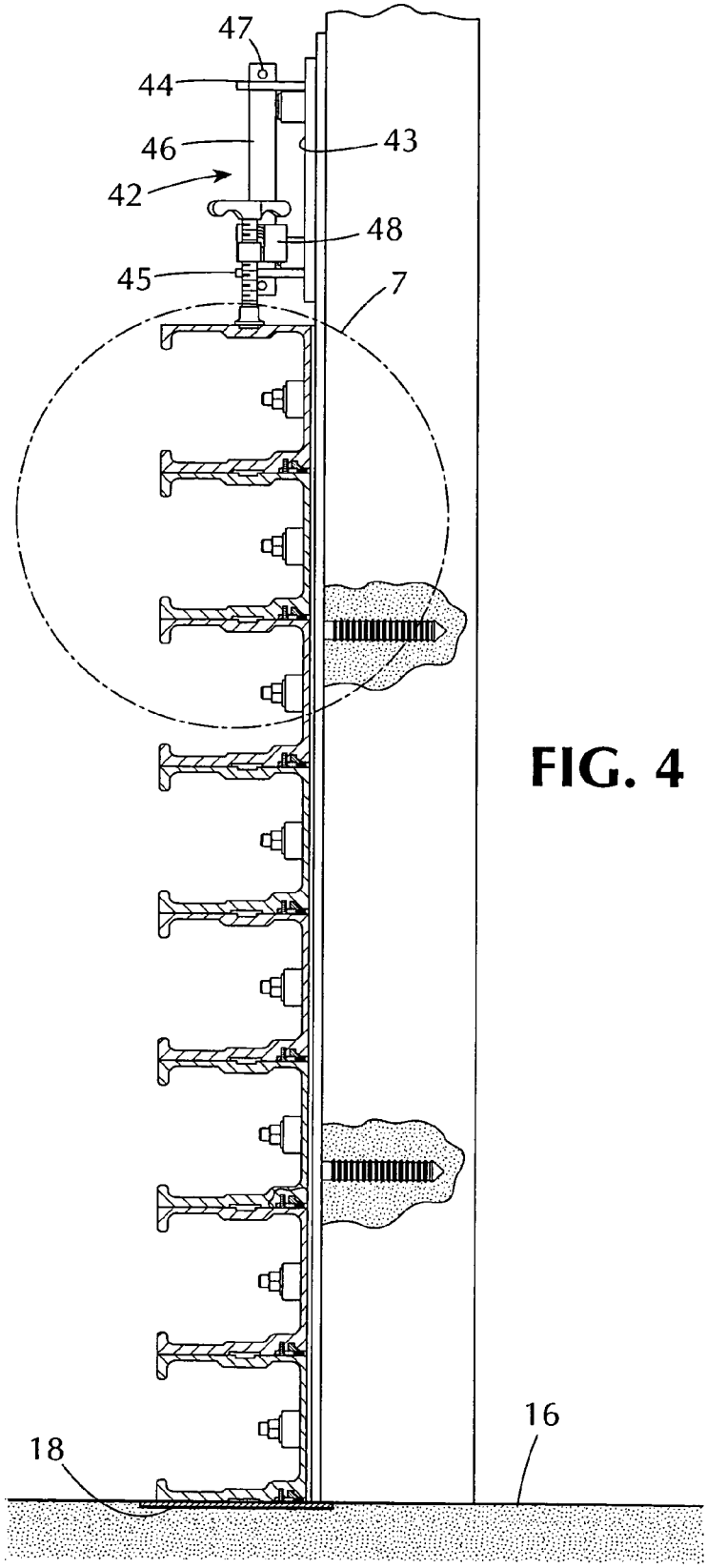
FIG. 4 is a cross sectional view as taken generally on line 4-4 of FIG. 2.

Referring now to the drawings, the reference numeral 10 designates generally a wall structure of a typical commercial building, for example, having an opening 11 therein. In the illustrated example, the opening 11 is intended to represent a typical doorway. The upper portion of the wall structure 10 and the opening 11 is omitted from the illustration as it plays no part in the description of the invention. Along each side 12, 13 of the opening 11 there are vertically disposed sealing plates 14, 15 which extend from ground level (shown at 16) for a suitable vertical distance for dealing with expected flooding levels in the region. Typically, for an opening 11 of significant height, such as a doorway, a flood barrier need not extend for the full height of the opening and, in the illustrated embodiment of the invention, the sealing plates 14, 15 may extend upward for a distance of around five feet, suitable for constructing a flood barrier of about four feet in height. The sealing plates 14, 15 are formed of flat, smooth steel of for example five inches in width and about ⅜th inch in thickness. The particular dimensions of the sealing plates may to some extent be a function of the size of the opening to be protected which, in the illustrated case, is about four feet in width and is arranged for installation of a flood barrier of about four feet in height. The sealing plates are firmly anchored to the wall structure by means of suitable bolts 17 (FIG. 4). A sill plate 18 (FIG. 4) is installed flush with the floor level 16 and extends across the full width of the opening 11 and preferably somewhat beyond, typically to align more or less with the outer edges of the vertical sealing plates 14, 15.

At spaced intervals along the full height of the sealing plates 14, 15 are stud bolts 19, which are fixed to the sealing plates, typically by welding, and project outward a short distance. In the illustrated embodiment, the lowermost stud bolt 19 may be located about three inches above the sill plate 18, and the remaining stud bolts may be spaced vertically on six inch centers. Each of the stud bolts 19, with the exception of the uppermost two on each side, which are identified by the reference numerals 20, 21, carry a horizontally acting end clamp element 22 which can be tightened on the stud bolt by means of a nut 23 (FIG. 5).

Figure 5:
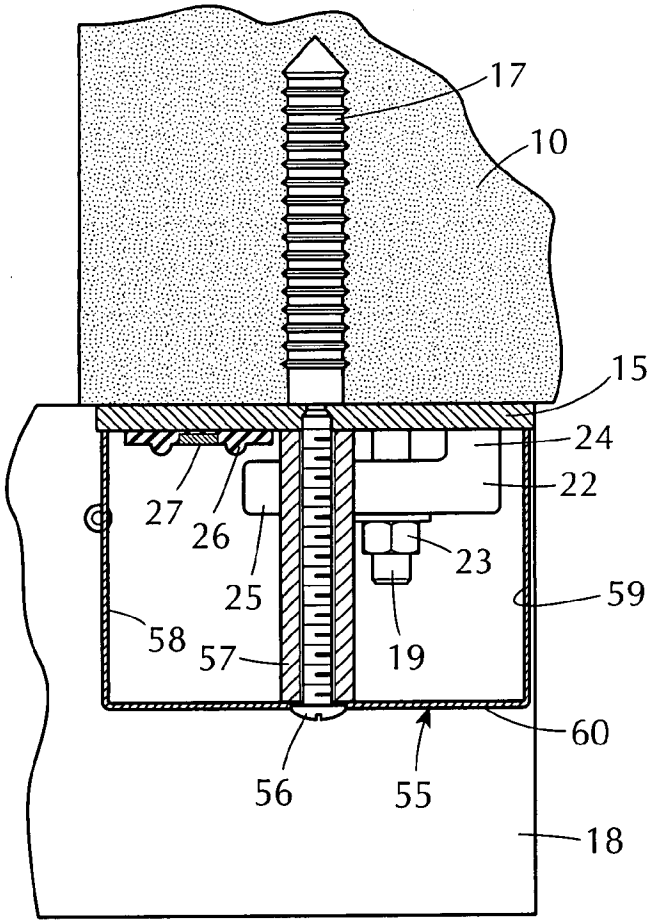
FIG. 5 is a cross sectional view as taken generally at 5-5 of FIG. 4.

As shown particularly in FIG. 5, the horizontally acting end clamp elements 22 are of generally L-shaped configuration, comprising a base portion 24 engaging the sealing plate 14 or 15, and a clamping arm portion 25 engaging the stud bolt 19 and extending inwardly for an inch and a half or so beyond the stud bolt and in spaced overlying relation to the front surface of the sealing plates 14, 15.

Along the inner margin of each of the sealing plates 14, 15 there is a vertically extending, resilient sealing strip 26 which is secured to the sealing plate 14, 15 by means of a thin metal strip 27 extending the full length of the sealing strip 16 and secured to the plate 14, 15 by suitable screws or the like (not shown).

Figure 1:
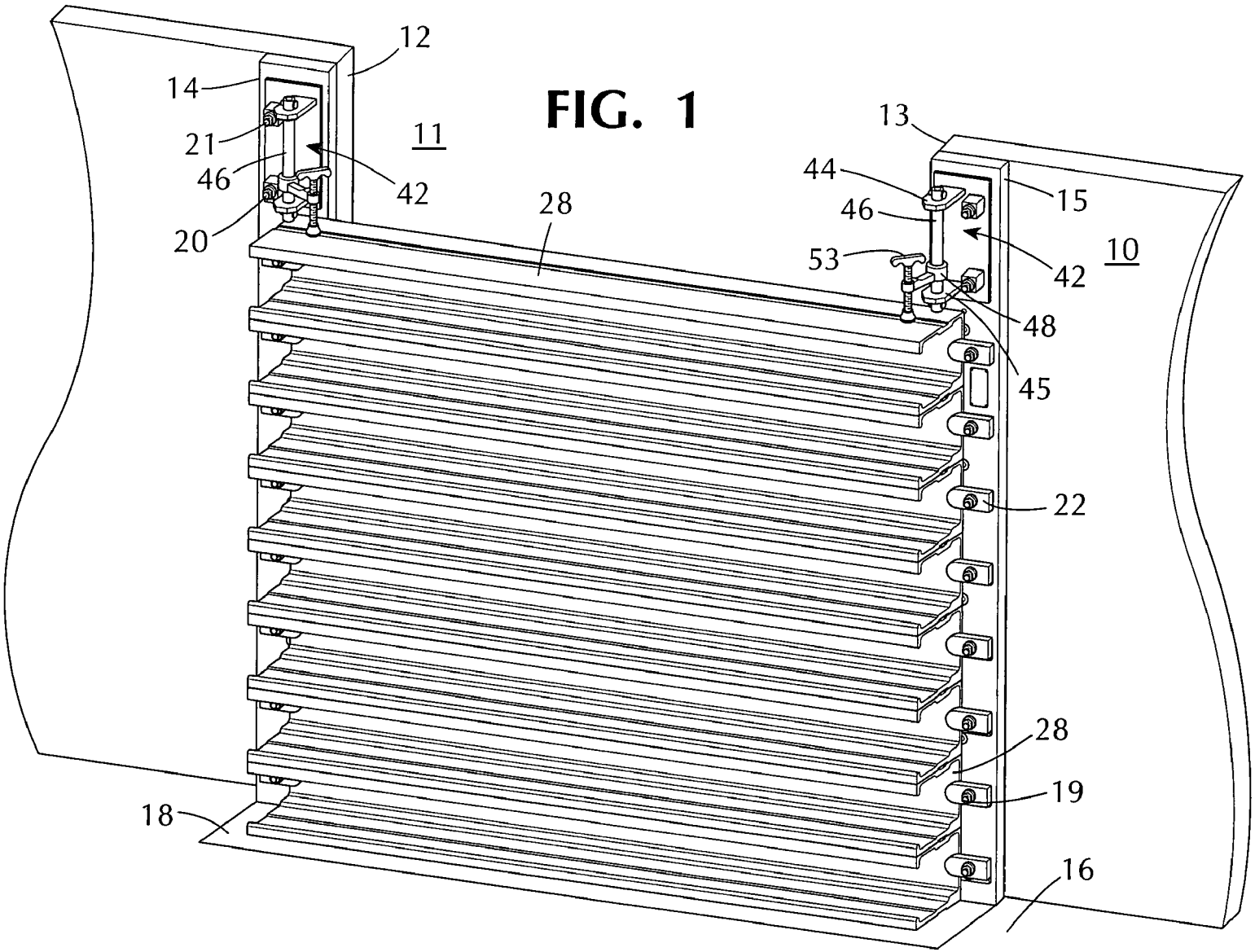
FIG. 1 is a perspective view of a wall structure showing the flood barrier system of the invention installed to protect an opening in the wall structure.
Figure 2:
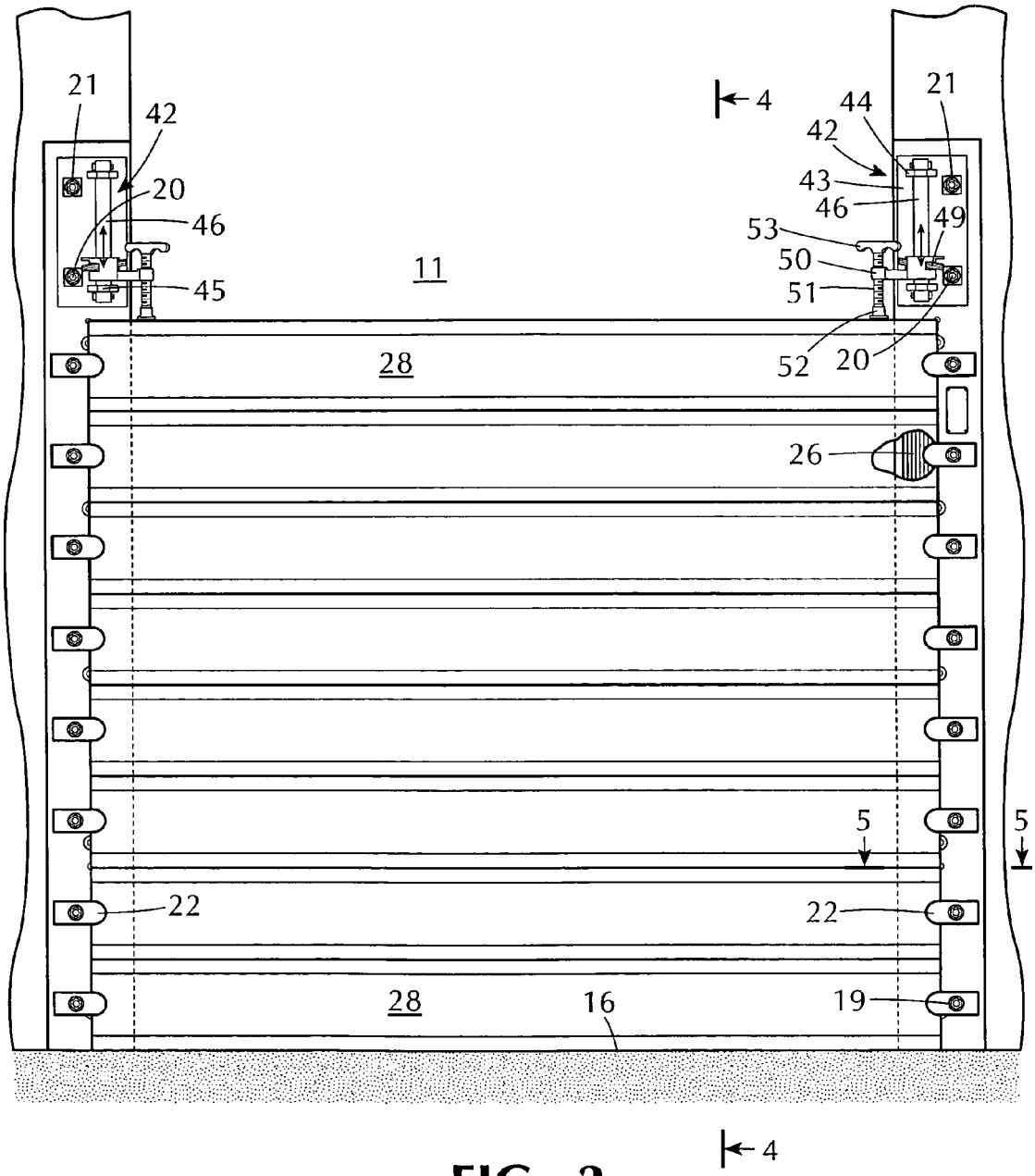
FIG. 2 is a front elevational view of the flood barrier system of FIG. 1.
Figure 3:
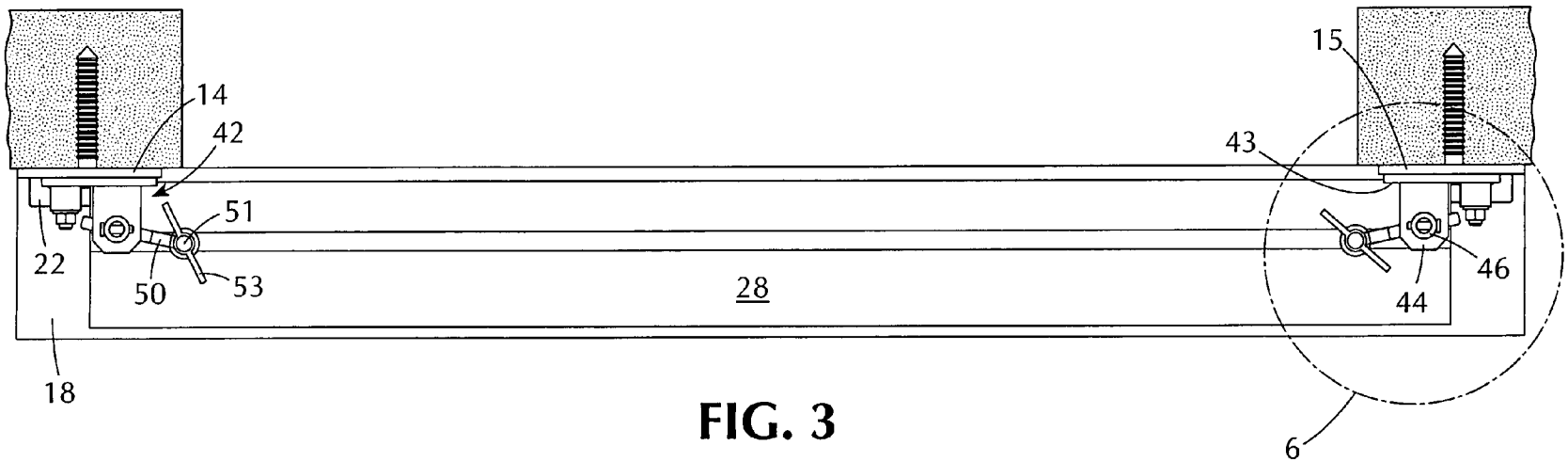
FIG. 3 is a top elevational view of the flood barrier system of FIG. 1.

A plurality of barrier elements 28 are preferably of a C-shaped cross section but possibly also of a closed tubular cross section, are placed one atop the other and extend across the full width of the opening 11, as shown particularly in FIGS. 1 and 2. In the illustrated form of the invention, the barrier elements 28 are lengths of extruded aluminum comprised of a back wall 29 having a flat back surface 30 and upper and lower walls 31, 32 disposed at right angles to the back wall 29. The specific size is not critical to the invention, but an advantageous size for the barrier elements is approximately six inches on a side, such that a barrier system as illustrated, consisting of eight barrier elements stacked one on top of the other creates a flood barrier of four feet in height. It will be understood, of course, that the height of a particular flood barrier system can be adjusted upward or downward as appropriate to the anticipated worst-case flood conditions.

The overall length of the barrier elements 28 is such that, when installed across the opening 11, their opposite end portions will overlap the inner margins of the respective sealing plates 14, 15 and will be in contact with the vertically extending, resilient sealing strips 26. Additionally, as indicated in FIG. 2, the opposite end extremities of the barrier elements will underlie the horizontally acting end clamp elements 22 at each side such that the flat back surfaces 30 of the barrier elements can be pressed against the resilient sealing strips 26 to provide a lateral seal.

During the installation of the individual barrier elements 28, one or both of the horizontally acting end clamp elements 22, engageable with the opposite ends of the barrier element, will be rotated away from a horizontal position in order to accommodate installation at the barrier element. Thereafter, the end clamp elements may be rotated to a horizontal orientation, as shown in FIG. 2. Eventually, the end clamp elements 22 will be tightened securely against the outer ends of the barrier elements 28. Initially, however, the end clamps 22 preferably are just lightly tightened during the initial installation until all of the barrier elements are in place. In this respect, it will be understood that the installation of the individual barrier elements proceeds from the bottom to the top, each barrier element being installed on top of the one below and each one being held lightly in place by the initially tightened end clamp elements 22.

Figure 7:
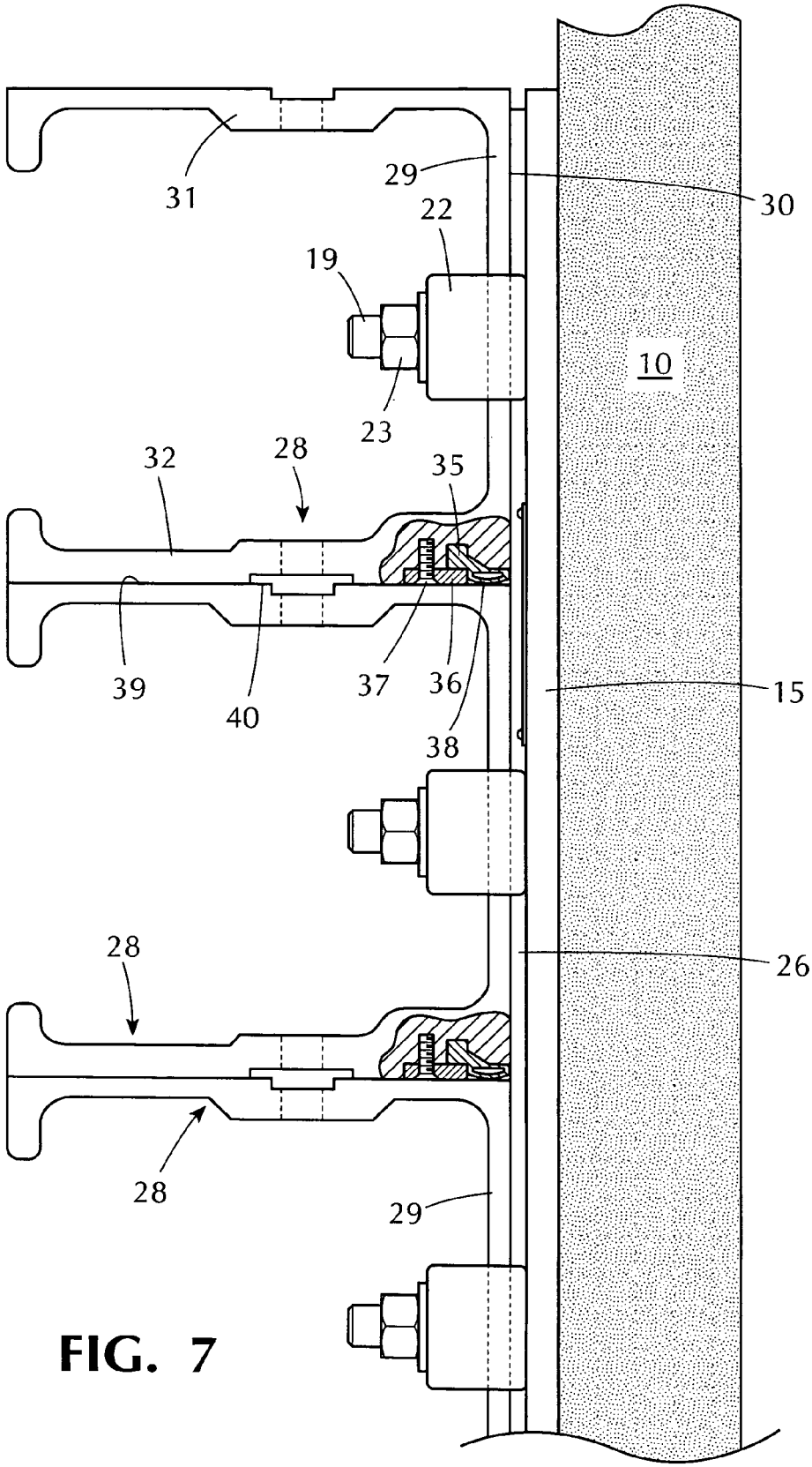
FIG. 7 is an enlarged, fragmentary end elevational view of a portion of the assembled flood barrier system, illustrating a preferential form of resilient seal positioned between flood barrier elements.

In accordance with one aspect of the invention, instead of bolting the lowermost barrier element 28 to the floor 16, and then individually bolting the subsequently installed barrier elements each to the element below, provisions are made for applying vertical clamping force to the entire "stack" of barrier elements 28 such that each is tightly compressed against the other to form an effective liquid seal between them. In this respect, each of the barrier elements 28 is provided adjacent a lower inner corner region with a recess for receiving a compressible resilient sealing element 35 (FIG. 7) extending the full length of the barrier element and secured in place by means of a retaining strip 36 fastened at spaced intervals by screws 37. In their normal or "at rest" configuration, the lower portions 38 of the resilient seals 35 extend below the lower surfaces of the barrier elements 28. Accordingly, when one barrier element is placed on top of another, the seals 35 are engaged and compressed by upper surfaces 40 of the barrier element below, in order to provide a watertight seal along the full lengths of the inner edges of the meeting surfaces of vertically adjacent barrier elements.

After the several barrier elements 28 are stacked against the front faces of the sealing plates 14, 15 and snugly engaged by the end clamps 22, downward pressure is applied to the barrier elements by vertically acting pressure clamps 42, in order to form a tight seal between the vertically adjacent barrier elements. Pursuant to one aspect of the invention, the vertically acting pressure clamps 42 are mounted at the upper ends of the sealing plates 14, 15 by means of the bolts 20, 21. Advantageously, although not necessarily, the bolts 20, 21 are secured to the sealing plates by the same means and on the same spacing as the lower bolts 19, in order to simplify manufacture.

Each of the vertically acting pressure clamps 42 comprises a base plate 43 on which are mounted upper and lower brackets 44, 45 which extend outward from the base plate 43 and mount a carrier pipe 46 in a vertical orientation. The carrier pipes advantageously are removably secured by means of pins 47 at each end. Each of the carrier pipes 46 slideably mounts a clamp body 48, which is movable between upper and lower limits on the carrier pipe 46, as determined by the mounting brackets 44, 45. The clamp body 48 may be of a known construction, incorporating a plurality of locking plates 49 which surround the carrier pipe 46 and, when disposed at an angle to the carrier pipe will lockingly engage the pipe and prevent axial movement of the clamp body 48. When the clamp body is under no axially upward load, the clamping plates 49 are easily manipulated to a right angle position with respect to the carrier pipe 46, allowing the clamp body to be adjustably positioned upward or downward along the pipe. When a vertically upward load is applied to the clamp body, the clamping plates 49 are tilted with respect to the pipe and prevent upward movement of the clamp body.

Each of the clamp bodies includes an outwardly extending arm 50 which threadedly engages a screw shaft 51 having a pad 52 at its lower end for engaging the uppermost barrier element 28 and having a manually engageable handle 53 at its upper end for advancing or retracting the threaded shaft 51. The threaded shaft portions 51 are of finite, and typically relatively short length, but can be brought into operative position by lowering the clamp bodies 48 to positions at or near lower limit positions on the carrier pipes 46. Thereafter, the handles 53 can be rotated to cause the clamps to be moved vertically downward onto the upper barrier element 28, applying vertical clamping pressure throughout the entire stack of barrier elements to provide a desired seal between vertically adjacent elements and between the bottom element and the floor surface 16.

During the initial installation of the barrier elements 28, the vertically acting pressure clamps can be retracted upward, to their upper limit positions along the carrier pipes 46, and they can also be swung out of the way if desired, to facilitate installation of the barrier elements. Once the last barrier element 28 is in place, the clamp bodies can be rotated to position the clamping screw shafts 51 directly over upper surface portions of the upper barrier element. Thereafter, with the screw elements 51 having first been rotated to somewhat retracted positions with respect to their mounting arms 50, the clamp bodies 48 are lowered to positions at or near their lower limit positions, substantially as shown in FIGS. 1, 2 and 4. Thereafter, the clamping screws 51 are rotated to bring the clamping pads 52 into pressure engagement with the upper surface of the uppermost barrier element 28. The clamping screws can be significantly tightened to provide the desired clamping pressure throughout the stack of barrier elements 28 as will be understood.

After applying the desired vertical pressure through the vertically acting pressure clamps 42, the individual end clamps 22 can be given a final tightening, to press the barrier elements 28 tightly against the vertical sealing strips 26 to complete the perimeter seal.

After the flood threat is over, the barrier elements 28 are removed, taken away and stored. This can be accomplished very expeditiously with the system of the invention, by releasing the clamping screws 51 and raising and swing the clamp bodies 48 to out of the way positions. Thereafter, the end clamps 22 are loosened to free the individual barrier elements which are then removed and taken away to a storage location.

Figure 6:
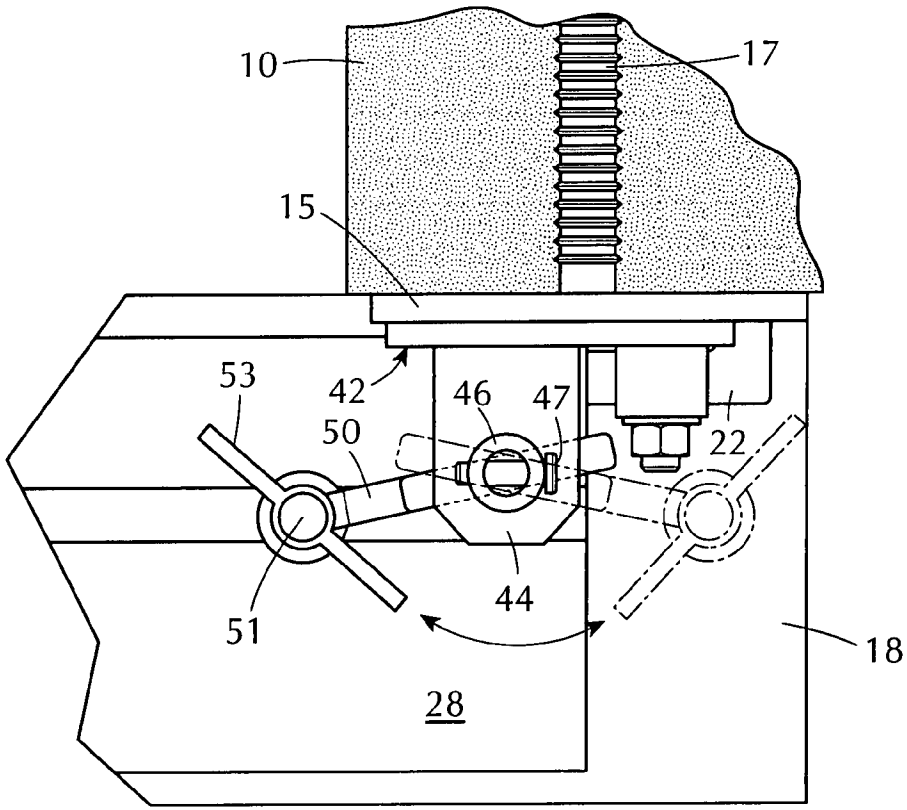
FIG. 6 is an enlarged fragmentary top plan view of the flood barrier system, illustrating details of the vertically acting pressure clamp arrangement.

Inasmuch as the next occurrence of flooding conditions may not take place for a considerable period of time, it is desirable to cover the sealing plates 14, 15 and the various items projecting therefrom, not only for the sake of appearance, but also to prevent injury to people from bumping into the projecting bolts and/or clamping elements, and also to protect the elements themselves from potential loss or damage. To this end, vertically extending shrouds 55 are provided, which are secured to the front faces of the sealing plates 14, 15, by means of bolts 56 and spacers 57 and extend more or less for the full height of the sealing plates. The shrouds are formed of stiff sheet metal and have opposed side walls 58, 59 spaced apart approximately the same width as the sealing plates 14, 15 and a front wall 60, spaced outward from the sealing plates a suitable distance to enclose the mechanism of the vertically acting pressure clamps 42. As shown in FIG. 6, the clamp body 48 can be pivoted around the carrier pipe 46, to a position (shown in dotted lines in FIG. 6) in which it can be contained within the space provided by the shroud 55. The arrangement is such that, when the shrouds are installed, the pressure clamps as well as all of the end clamps and their various bolts, etc. are completely concealed and protected by the shrouds. When the next flooding incident takes place, the shrouds can be quickly removed, making the front faces of the sealing plates 14, 15 and the respective vertical pressure clamps available for immediate use.

The system of the invention has important practical advantages to the user in that it greatly simplifies and expedites the time and effort involved in erecting the flood barrier when the occasion arises and when response time may be of the essence to avoid inundation of the property. The individual barrier elements 28 can be quickly stacked against the sealing plates 14, 15 and snugly clamped there-against, after which the vertically acting pressure clamps are swung and slid into position and tightened to complete the seals between horizontally stacked elements. The final tightening of the end clamps 22 completes the process, all of which is accomplished with a minimum of time and effort.

Significant savings are also realized in the manufacturing stage inasmuch as the drilling of multiple holes in each of the top and bottom elements of each barrier element is avoided. In addition the providing and handling of a large number of bolts is eliminated.

It should be understood, of course, that the specific forms of the invention herein illustrated and described are intended to be representative only, as certain changes may be made therein without departing from the clear teachings of the disclosure. Accordingly, reference should be made to the following appended claims in determining the full scope of the invention.

The invention claimed is:

1. A flood barrier system for sealing an opening in a permanent wall structure of a building against the inflow of flood waters into said building, which comprises (a) a plurality of portable elongated barrier elements of a length greater than a width of the opening, (b) said barrier elements being oriented horizontally and stacked vertically one upon the other against an outer face of said wall structure, (c) said barrier elements being positioned with opposite end portions thereof overlapping outer surfaces of said wall structure laterally adjacent opposite sides of said opening, (d) a horizontal support surface for a lowermost one of said barrier elements extending for the width of said opening, (e) horizontally acting clamping elements engaging the end portions of said barrier elements for retaining said end portions in sealing relationship with said outer surfaces of said wall structure overlapped thereby, and (f) vertically acting adjustable pressure clamps mounted on said wall structure and positioned above opposite end portions of an uppermost one of said barrier elements, (g) said vertically acting pressure clamps being operable to bear downwardly upon said uppermost barrier element and thereby being operative to vertically compress the entire plurality of stacked barrier elements to provide a water tight seal between each of the vertically adjacent barrier elements and between said lowermost barrier element and said support surface to form a water tight barrier at said opening.

2. A flood barrier system according to claim 1 wherein (a) each of said pressure clamps comprises a clamp body carrying an adjustable clamping element movable through a limited vertical range with respect to said clamp body, and (b) a vertically disposed carrier element secured to said wall structure above said uppermost barrier element and spaced outwardly of said wall structure for mounting said clamp body for limited vertical movement when said adjustable clamping element is not under load.

3. A flood barrier system according to claim 2 wherein (a) said vertically disposed carrier element is of generally circular cross section, (b) said adjustable clamping element comprises a screw threaded element having threaded engagement with said clamp body and carrying a clamping pad at its lower end, and (c) said clamp body is mounted for swinging movement about a vertical axis of said carrier element between an operative position, with said clamping pad positioned above an end portion of said uppermost barrier element, and a retracted position with said clamping pad positioned away from said end portion.

4. A flood barrier system according to claim 3 wherein (a) a plurality of locking plates are carried by said clamp body and engageable with said vertically disposed carrier element, (b) said locking plates serving to fix the position of said clamp body on said carrier element when said clamp body is under load, while allowing vertical adjustment of said clamp body when not under load.

5. A flood barrier system according to claim 2 wherein (a) vertically disposed sealing plates are mounted on the outer face of said wall structure adjacent each side of said opening, for engagement with said barrier elements, and (b) resilient sealing elements are positioned between said sealing plates and said barrier elements.

6. A flood barrier system according to claim 5 wherein (a) said sealing plates have upper portions extending above the uppermost barrier element, and (b) said vertically acting pressure clamps are mounted on said upper portions of said sealing plates.

7. A flood barrier system according to claim 6 wherein (a) mounting bolts extend outward from said sealing plates at locations adjacent to end extremities of said barrier elements, and (b) said horizontally acting clamping elements are positioned on said mounting bolts and have portions engaging end extremities of said barrier elements for applying horizontal sealing pressure thereto.

8. A flood barrier system according to claim 7 wherein (a) said upper portions of said sealing plates each have at least one bolt projecting outward therefrom, and (b) said vertically acting pressure clamps are mounted on said upper portions by said at least one bolt.

9. A flood barrier system according to claim 8 wherein (a) each of said vertically acting pressure clamps comprises a vertically extending base plate mounting said carrier element by upper and lower end portions thereof, and (b) said vertically disposed carrier element is spaced outward from said base plate to accommodate vertical sliding and rotary pivotal movements of said clamp body.

10. A flood barrier system according to claim 1 wherein (a) said barrier elements mount resilient, compressible sealing elements along lower forward edge portions thereof for sealing engagement with an underlying surface.

11. A flood barrier system according to claim 10 wherein (a) said barrier elements are of generally uniform cross section along their length and have a vertical wall confronting said wall structure and upper and lower walls extending outward from upper and lower edges of said vertical wall.

12. A flood barrier system according to claim 11 wherein (a) said barrier elements are of generally C-shaped cross section.

* * * * *